United States Patent [19]

Toshima

[11] Patent Number: 4,780,577

[45] Date of Patent: Oct. 25, 1988

[54] ELECTRICAL BUSHING OF A GAS INSULATED ELECTRICAL APPARATUS

[75] Inventor: Norichika Toshima, Amagasaki, Japan

[73] Assignee: Mitsubishi Denki Kabushiki Kaisha, Japan

[21] Appl. No.: 24,476

[22] Filed: Mar. 11, 1987

[30] Foreign Application Priority Data

Mar. 12, 1986 [JP] Japan ..... 61-52638

[51] Int. Cl.[4] ..... H01B 17/26; H01B 17/42

[52] U.S. Cl. ..... 174/142; 174/31 R

[58] Field of Search ..... 174/15 BH, 16 BH, 31 R, 174/142, 143

[56] References Cited

FOREIGN PATENT DOCUMENTS 52-8495 1/1977 Japan ..... 174/142

53-96699 8/1978 Japan ..... 174/143

*Primary Examiner*—Laramie E. Askin

*Attorney, Agent, or Firm*—Leydig, Voit & Mayer

[57] ABSTRACT

An electrical bushing of a gas insulated electrical apparatus comprises an insulating tube, a central conductor extending through the insulating tube and a cylindrical shield disposed between the central conductor which is electrically connectable to ground at one end and has an electrical field moderating ring integrally formed therewith at the other end thereof. The central conductor has a reduced diameter portion in the vicinity of the electric field moderating ring of the cylindrical shield and large diameter portions and tapered portions connecting the reduced diameter portion to the large diameter portions. Thus, since the reduced diameter portion is formed in a region where the electric field strength is high, the concentration of the electric field in that region is moderated, thereby resulting in an improvement in the withstand voltage characteristic of the bushing. The reduced diameter portion can be formed as a separate member. Also, the reduced diameter portion may itself have portions of different diameters.

3 Claims, 3 Drawing Sheets

ELECTRICAL BUSHING OF A GAS INSULATED ELECTRICAL APPARATUS

BACKGROUND OF THE INVENTION

This invention relates to an electrical bushing of a gas insulated electrical apparatus and more particularly to an electrical bushing of a gas insulated electrical apparatus comprising a high voltage central conductor and a grounded shield within an insulating tube.

FIG. 1 illustrates an example of a conventional electrical bushing which is disclosed in Japanese Patent Application Laid Open No. 56-30211.

The conventional electrical bushing comprises an insulating tube 1 such as a porcelain tube, an upper mounting fixture 1*a* secured to one end of the tube 1, an upper terminal 10 hermetically secured to the tube 1 through the fixture 1*a*, a lower mounting fixture 1*b* secured at the other end of the tube 1, a flange 4 which is grounded and to which the fixture 1*b* is hermetically secured and a vessel 5 provided at the top end thereof with a flange member 5*a* which is hermetically secured to the flange 4.

The electrical bushing further comprises a central conductor 2, which is used as a high voltage electrode and is axially disposed at the center of the hollow portion of the tube 1, a cylindrical shield 3, which is grounded and is secured at one end thereof to the inner circumferential edge of the flange 4 so as to surround the central conductor 2 and has an electric field moderating ring 3*a* formed at the other end thereof, and an insulating medium 6, such as $SF_6$ gas, confined within the electrical apparatus.

Since it has been recently attempted to minimize the size of the insulating tube so that the production cost thereof may be cut down, the inner space of the tube 1 is very limited and accordingly the insulating distance between the field moderating ring 3*a* of the cylindrical shield 3 and the central conductor 2 becomes very short.

The thus constructed conventional electrical bushing has problems in that, when a high voltage is applied to the central conductor 2, the equipotential surfaces of the electric field are very dense between the field moderating ring 3*a* of the shield 3 and the central conductor 2 and the electric field strength around that portion is therefore considerably high, resulting in a limitation to the withstand voltage of the electrical bushing. Accordingly, the field moderating ring 3*a* must have a cross-sectional shape having as large a radius as possible and must be away from the central conductor 2 as far as possible. However, it is difficult to satisfy these conditions within the limited inner space of the tube 1.

SUMMARY OF THE INVENTION

Accordingly, an object of this invention is to provide an electrical bushing of a gas insulated electrical apparatus free from the above discussed problems.

Another object of this invention is to provide an electrical bushing of a gas insulated electrical apparatus having a superior withstand voltage characteristic.

According to this invention, the electrical bushing comprises an insulating tube, a central conductor extending through the insulating tube, a cylindrical shield disposed between the insulating tube and the central conductor so as to surround the central conductor, the cylindrical shield being electrically connectable to ground at one end and having an electric field moderating ring at the other end thereof. The central conductor has a reduced diameter portion in the vicinity of the field moderating ring of the shield, large diameter portions and tapered portions conecting the reduced diameter portion to the large diameter portions. The reduced diameter portion preferably has an axial length equal to or greater than the inner diameter of the insulating tube.

According to this invention, since the central conductor is provided with a reduced diameter portion in a portion where the electric field strength is high in the insulating bushing, the necessary insulating distance is provided in that portion, and the concentration of the electric field is moderated, so that the electric field strength is lowered.

BRIEF DESCRIPTION OF THE DRAWINGS

This invention will become more readily apparent from the following description of the preferred embodiments of the invention taken in conjunction with the accompanying drawings, in which.

DESCRIPTION OF THE PREFERRED EMBODIMENTS

Figure 1:
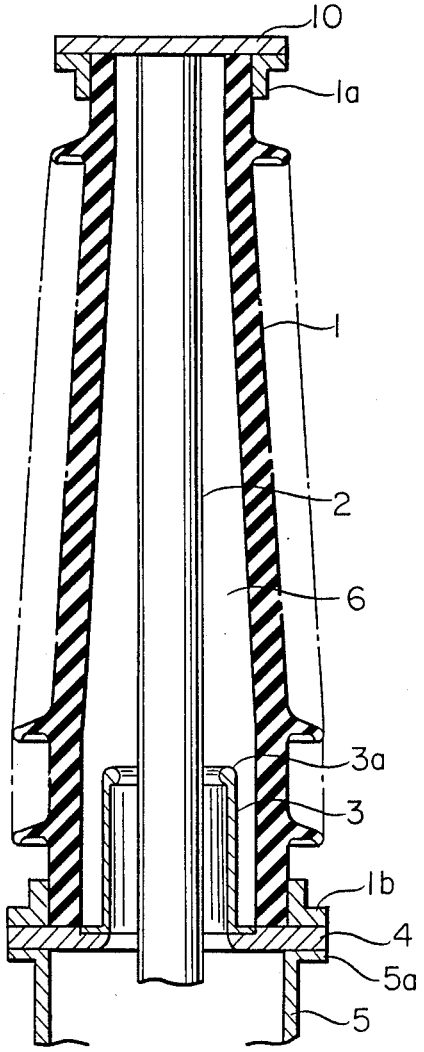
FIG. 1 PRIOR ART
FIG. 1 is a longitudinal sectional view of a conventional electrical bushing.
Figure 2:
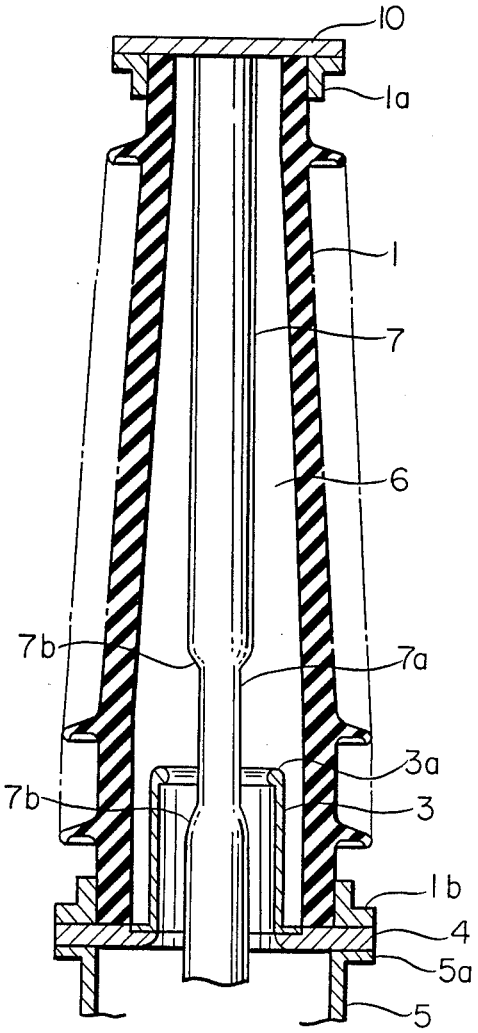
FIG. 2 is a longitudinal sectional view of an electrical bushing according to an embodiment of this invention.

FIG. 2 illustrates an electrical bushing of a gas insulated electrical apparatus according to an embodiment of this invention. The electrical bushing is substantially similar to the bushing shown in FIG. 1 except for the configuration of a central conductor. In other respects, the structure is the same as that of the conventional bushing illustrated in FIG. 1.

In the illustrated embodiment, the electrical bushing includes a central conductor 7 having a reduced diameter portion 7*a* in the vicinity of the field moderating ring 3*a* of the cylindrical shield 3. The reduced diameter portion starts from a point on the conductor 7 which is a little away from the field moderating ring 3*a* toward a ground side by a distance which raises no problems in terms of the internal electric field, and extends toward the source side by a distance at least equal to the inner diameter of the insulating tube 1. The reduced diameter portion 7*a* is smoothly connected at both ends thereof to large diameter portions through tapered portions 7*b*.

Thus, the reduced diameter portion 7*a*, which is formed in the vicinity of the field moderating ring 3*a* of the cylindrical shield 3, and the insulating tube 1 are sufficiently away from each other, whereby the equipotential surfaces which were dense in the conventional electrical bushing shown in FIG. 1 are less dense, whereby the concentration of the electric field can be moderated and at the same time the electric field strength between the field moderating ring 3*a* and the central conductor 7 can be lowered.

The equipotential surfaces between the field moderating ring 3*a* of the shield 3 and the reduced diameter portion 7*a* of the central conductor 7 are balanced in comparison with those of other portions within the insulating tube 1 because the diameters of the central conductor 7 and the cylindrical shield 3 are appropriately selected. When the diameter of the central conductor 7 is reduced in the vicinity of the field moderating ring 3*a* around which the electric field is strongest within the insulating tube 1, the electric field strength on the reduced diameter portion 7*a* of the central conductor 7 is high, on one hand, when only the round configuration of the field moderating ring 3*a* is taken into consideration. However, on the other hand, since the insulating distance between the reduced diameter portion 7*a* and the field moderating ring 3*a* is large, the electric field established therebetween has a strength substantially equal to the field strength of the conventional arrangement.

Figure 3:
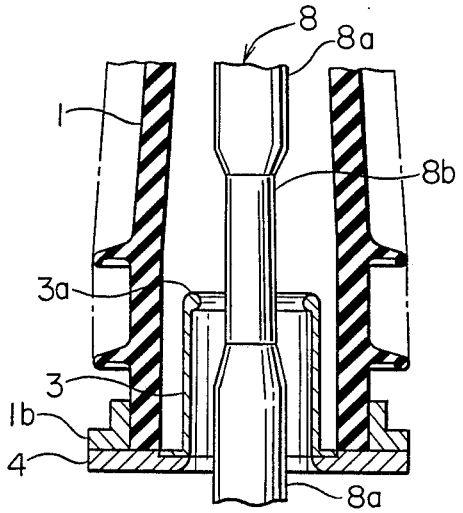
FIG. 3 is a longitudinal sectional and partial view of an electrical bushing according to another embodiment of this invention.

FIG. 3 illustrates an electrical bushing of a gas insulated electrical apparatus according to another embodiment of this invention.

According to this embodiment, the electrical bushing includes a central conductor 8 having large diameter portions 8*a* which are made of aluminium and a separate reduced diameter member 8*b* made of a material having a higher electrical conductivity, such as copper. The large diameter portions 8*a* and the separate reduced diameter member 8*b* are welded to each other. According to this embodiment, the problem of non-uniform temperature rise when a large current flows through the narrow reduced diameter portion 8*b* is eliminated.

Figure 4:
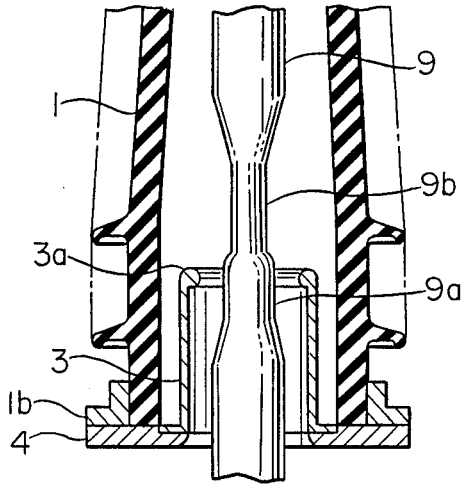
FIG. 4 is a longitudinal sectional and partial view of an electrical bushing according to still another embodiment of this invention.

FIG. 4 illustrates an electrical bushing of a gas insulated electrical apparatus according to still another embodiment of this invention, in which the electrical bushing includes a central conductor 9 having a first reduced diameter portion 9*a*, and a second reduced diameter portion 9*b* which has a smaller reduced diameter than the first reduced diameter portion 9*a*. The second reduced diameter portion 9*b* is provided in a position which is away from the field moderating ring 3*a* of the shield 3 so that the electric field strength is high between the central conductor 9 and the inner wall of the electrical bushing 1, thereby making it possible to further improve the withstand voltage characteristic of the electrical bushing.

As can be seen from the above description, according to this invention, the electrical bushing includes a central conductor having different diameters, i.e. a reduced diameter portion in the vicinity of the field moderating ring at one end of the cylindrical shield, large diameter portions and tapered portions connecting the reduced portion to the large diameter portions. The reduced diameter portion may start from a point on the conductor which is away from the field moderating ring, namely, a point where the electric field strength between the field moderating ring and the central conductor is less high, and may extend over an axial length at least equal to the inner diameter of the insulating tube. Therefore, the withstand voltage characteristic of the electrical bushing is significantly improved.

What is claimed is:

1. An electrical bushing of a gas insulated electrical apparatus comprising;

an insulating tube;

a central conductor extending through said insulating tube; and a cylindrical shield disposed between said insulating tube and said central conductor so as to surround said central conductor, said cylindrical shield being electrically connectable to ground at one end and having an electric field moderating ring at the other end thereof;

said central conductor including a separate member having a reduced diameter in the vicinity of said electric field moderating ring of said cylindrical shield, large diameter portions, and tapered portions connecting said separate reduced diameter member to said large diameter portions, said separate reduced diameter member having a higher electrical conductivity than that of said large diameter portions to reduce non-uniform temperature rise in said central conductor when a large current flows therethrough.

2. An electrical bushing of a gas insulated electrical apparatus as claimed in claim 1 wherein said separate reduced diameter member has an axial length which corresponds to at least the inner diameter of said insulating tube.

3. An electrical bushing of a gas insulated electrical apparatus comprising:

an insulating tube;

a central conductor extending through said insulating tube; and a cylindrical shield disposed between said insulating tube and said central conductor so as to surround said central conductor, said cylindrical shield being electrically connectable to ground at one end and having an electric field moderating ring at the other end thereof;

said central conductor having a reduced diameter portion in the vicinity of said electric field moderating ring of said cylindrical shield, large diameter portions, and tapered portions connecting said reduced diameter portion to said large diameter portions, said reduced diameter portion comprising a first diameter portion positioned immediately adjacent said electric field-moderating ring and a second diameter portion spaced longitudinally from said electric field-moderating ring, said second diameter portion having a smaller diameter than that of said first diameter portion.

* * * * *